US007212164B2

(12) United States Patent
Miyano et al.

(10) Patent No.: US 7,212,164 B2
(45) Date of Patent: May 1, 2007

(54) RADIO TERMINAL DEVICE ANTENNA AND RADIO TERMINAL DEVICE

(75) Inventors: Kentaro Miyano, Kanagawa (JP); Yoichi Nakagawa, Tokyo (JP); Masahiro Mimura, Tokyo (JP); Yoshio Koyanagi, Kanagawa (JP); Kyohei Fujimoto, Kanagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 81 days.

(21) Appl. No.: 10/505,372

(22) PCT Filed: Sep. 25, 2003

(86) PCT No.: PCT/JP03/12223

§ 371 (c)(1),
(2), (4) Date: Aug. 20, 2004

(87) PCT Pub. No.: WO2004/030146

PCT Pub. Date: Apr. 8, 2004

(65) Prior Publication Data

US 2005/0119035 A1 Jun. 2, 2005

(30) Foreign Application Priority Data

Sep. 26, 2002 (JP) ..... 2002-280994
Sep. 19, 2003 (JP) ..... 2003-327822

(51) Int. Cl.
*H01Q 1/24* (2006.01)
*H01Q 3/24* (2006.01)

(52) U.S. Cl. ..... 343/702; 343/741; 343/876; 343/893

(58) Field of Classification Search ..... 343/700 MS, 343/702, 876, 741, 866, 821, 893
See application file for complete search history.

(56) References Cited

U.S. PATENT DOCUMENTS 4,358,769 A * 11/1982 Tada et al. ..... 343/742
4,529,987 A * 7/1985 Bhartia et al. ..... 343/700 MS
4,538,153 A * 8/1985 Taga ..... 343/700 MS (Continued)

FOREIGN PATENT DOCUMENTS

EP 120600 A2 5/2002

(Continued)

OTHER PUBLICATIONS

International Search Report for PCT/JP2003/012223, dated Nov. 4, 2003.

*Primary Examiner*—Tan Ho
(74) *Attorney, Agent, or Firm*—RatnerPrestia

(57) ABSTRACT

A radio terminal device has an antenna element, a coil, a switch, an RF circuit section and a conductive substrate. The switch is used to switch between a case where current distribution exists only in the antenna element and its vicinities and a case where the current distribution exists not only in the antenna element and its vicinities but also in other places. Additionally, the switch is switched in accordance with the usage pattern in which the user uses the radio terminal device (e.g., telephone call and data communication). This allows the transmission/reception to be performed with the antenna polarization and directivity suitable for the usage pattern. Thus, there can be provided a radio terminal device that exhibits a reception characteristic suitable for a respective situation.

22 Claims, 16 Drawing Sheets

U.S. PATENT DOCUMENTS

| | | | | |
|---|---|---|---|---|
| 4,751,513 | A * | 6/1988 | Daryoush et al. | 343/700 MS |
| 4,800,393 | A * | 1/1989 | Edward et al. | 343/821 |
| 5,243,356 | A * | 9/1993 | Hama | 343/718 |
| 6,034,636 | A * | 3/2000 | Saitoh | 343/700 MS |
| 6,054,965 | A * | 4/2000 | Yamamoto | 343/860 |
| 6,300,909 | B1 * | 10/2001 | Tsubaki et al. | 343/700 MS |
| 6,535,545 | B1 * | 3/2003 | Ben-Bassat et al. | 375/142 |
| 6,549,086 | B2 * | 4/2003 | Kawanami | 333/1.1 |
| 6,593,886 | B2 * | 7/2003 | Schantz | 343/700 MS |
| 6,693,594 | B2 * | 2/2004 | Pankinaho et al. | 343/700 MS |
| 6,710,597 | B2 * | 3/2004 | Reykowski et al. | 324/318 |

FOREIGN PATENT DOCUMENTS

| | | | |
|---|---|---|---|
| EP | 1206000 | A2 | 5/2002 |
| JP | 61-200702 | A | 9/1986 |
| JP | 08-172374 | A | 7/1996 |
| JP | 09-023184 | A | 1/1997 |
| JP | 2001-223514 | A | 8/2001 |
| JP | 2001-326514 | A | 11/2001 |
| JP | 2002-043826 | A | 2/2002 |

* cited by examiner

RADIO TERMINAL DEVICE ANTENNA AND RADIO TERMINAL DEVICE

This application is a U.S. National phase application of PCT International Application PCT/2003/12223.

FIELD OF THE INVENTION

The present invention relates to an antenna for a radio terminal device and a radio terminal device.

BACKGROUND OF THE INVENTION

In case of the PDC system, as for a conventional antenna for a radio terminal device, a diversity antenna in combination of a whip antenna 102 and a planar inverted F antenna 103, as shown in FIG. 20, has been used well for dealing with a fading problem. However, all of these antennas have the polarization in which the z-axis directional component is big. Therefore, in a radio communications system transmission/reception in the vertical polarization at the base station, when a portable phone is used for telephone call and data communications as shown in FIG. 21, the polarization loss becomes small at the time of data communications as the polarization is the same vertical polarization, while the polarization loss becomes great depending on the slope of a plane of polarization at the time of telephone conversation.

Accordingly, in any states such as telephone call or data communications, there was described an antenna from which good polarization characteristics can be obtained, for example, in JP-A-2001-326514. FIG. 22 illustrates a conventional radio terminal device as described in the aforementioned patent publication.

In FIG. 22, a radio terminal device has one or a plurality of conversion switches 2202 for switching electrical connection state on an antenna element 2201 in which the electrical length is approximately 1 wavelength for a frequency in use. By switching the conversion switches 2202, the main polarization characteristic of an antenna can be switched to the horizontal polarization and vertical polarization. Meanwhile, a conversion control circuit section 2203 is provided with a discriminating means of a communication media such as voice communications/data communications or a discriminating means to decide whether any external device is connected to the radio terminal device. By switching the conversion switch 2202 based on the discrimination results from such discriminating means, the user is able to have a good plane of polarization automatically without awareness.

Meanwhile, there was mentioned a technique to switch the polarization and the directivity of an antenna by switching an antenna to the balanced characteristic and unbalanced characteristic in JP-A-2002-43826. FIG. 23 illustrates a conventional radio terminal device as described in the aforementioned patent publication.

In FIG. 23, the radio terminal device is provided with a rectangular loop antenna element 2303 of 1 wavelength arranged in the proximity of a radio substrate 2301 and both ends of the loop antenna element 2303 are bent so as to face toward a feeding section, thus configuring the current distribution that a current in the most front end portion becomes zero. Also, by concentrating the current on the loop antenna element 2303, the current component flowing on the radio substrate 2301 is reduced and the influence when a human being holds the radio terminal device in the hand is suppressed, and the directive characteristic is formed according to the arrival wave at the same time. Furthermore, by adjusting a phase circuit 2304, it is possible to switch the balanced characteristic and the unbalanced characteristic or to have a state therebetween and to form a plurality of radiation directional patterns in one antenna system depending on the environment of use or an arrival radio wave.

Meanwhile, other than the above JP-A-2002-43826, there was mentioned about controlling the directivity of an antenna by changing the current distribution in JP-A-2001-223514. FIG. 24A and FIG. 24B show a configuration of a case current distribution control section of the conventional radio terminal device as described in this patent publication.

In FIG. 24A, in the case current distribution control section, metal plates 2401 such as an case in a plurality of shapes of strips having a predetermined width are arranged at predetermined intervals, and connected by means of devices such as a plurality of diodes 2402 or the like therebetween. Then, by turning ON/OFF the switch 2404 of a bias control circuit 2403, voltages applied to diodes 2402 are controlled and the current distribution is switched.

However, in the conventional method as described in JP-A-2001-326514, there were problems in that an antenna element of approximately 1 wavelength was needed, which could not be installed at the case in view of a configuration of an antenna so that it was difficult to produce a small-sized terminal. Meanwhile, the conversion switch 2202 served as a means to switch an impedance matching circuit and switching at the same frequency band was not considered.

Meanwhile, according to the conventional method as described in JP-A-2002-43826, a small-sized antenna could be produced by using a folded loop antenna, but there was a problem in that the balanced characteristic and unbalanced characteristic could not be switched at the same frequency band as they were switched at the phase circuit.

Also, as for the conventional method as described in JP-A-2001-223514, there was a problem in that many devices such as diodes and the like were needed for the control of the current distribution.

DISCLOSURE OF THE INVENTION

An object of the present invention is to provide an antenna for a radio terminal device and a radio terminal device in which a small-sized product can be realized by configuring with an antenna element that is shorter than 1 wavelength and can be installed at an case, and in which the antenna characteristic can be switched at the same frequency band with a simple component configuration at the same time.

An antenna for a radio terminal device of the present invention comprises an antenna element; and an antenna characteristic switching section for switching between the states in which a current distribution exists only on and in the vicinity of the antenna element and in which a current distribution exists not only on and in the vicinity of the antenna element but also on the other portions.

Meanwhile, an antenna for a radio terminal device of the present invention comprises an antenna element; a conductive substrate arranged close in parallel to the long side of the antenna element with a sufficiently small spacing as compared with the wavelength in a twisted position relationship; and an antenna characteristic switching section, being connected to one end of the antenna element in the vicinity of the conductive substrate, for changing the state of continuity with the conductive substrate.

According to the above configuration, the polarization and the directivity of an antenna can be switched.

Meanwhile, in an antenna for a radio terminal device of the present invention, the antenna characteristic switching section has a switch and a coil connected each other in series and one end of the coil is connected to the antenna element.

Meanwhile, in an antenna for a radio terminal device of the present invention, the antenna characteristic switching section has a diode and a coil connected each other in series.

According to the above configuration, the polarization and the directivity of an antenna can be switched with a simple configuration so that a small-sized antenna can be produced.

Meanwhile, in an antenna for a radio terminal device of the present invention, any one of a loop antenna, dipole antenna, and diversity antenna is used as the antenna element.

Furthermore, in an antenna for a radio terminal device of the present invention, the antenna element is a dipole antenna and also an array antenna configured by two antenna elements.

According to the above configuration, a small-sized antenna can be produced and can be arranged on the case.

Meanwhile, a radio terminal device comprises an antenna element; a conductive substrate arranged close in parallel to the long side of the antenna element with a sufficiently small spacing as compared with the wavelength in a twisted position relationship; an antenna characteristic switching section, being connected to one end of the antenna element in the vicinity of the conductive substrate, for changing the state of continuity with the conductive substrate; and an RF circuit section connected to the other end of the antenna element.

Furthermore, a radio terminal device comprises an antenna element; a conductive substrate arranged close in parallel to the long side of the antenna element with a sufficiently small spacing as compared with the wavelength in a twisted position relationship; a RF circuit section connected to one end of the antenna element; and an antenna characteristic switching section which is connected to the portion in the vicinity of the end connected with the RF circuit section and in proximity to the conductive substrate, for changing the state of continuity with the conductive substrate, wherein the other end of the antenna element in proximity to the conductive substrate is connected to the conductive substrate.

Meanwhile, a radio terminal device comprises an antenna element; a conductive substrate arranged close in parallel to the long side of the antenna element with a sufficiently small spacing as compared with the wavelength in a twisted position relationship; a balanced/unbalanced converter connected to both ends of the antenna element; a RF circuit section connected to the balanced/unbalanced converter; and an antenna characteristic switching section being connected to the antenna element in the vicinity of the conductive substrate, for changing the state of continuity with the conductive substrate.

According to the above configuration, the polarization and the directivity of an antenna can be switched with a simple configuration so that receiving sensitivity can be improved.

Meanwhile, a radio terminal device of the present invention further comprises an operating pattern estimator for discriminating whether the present communication is a telephone call or a data communication, to notify the antenna characteristic switching section, wherein the antenna characteristic switching section performs a predetermined switching on the basis of the notification. According to this configuration, the polarization and the directivity of an antenna can be automatically switched according to the usage pattern of the radio terminal device so that the user can be served with communications without awareness and in a state with much higher sensitivity.

Meanwhile, a radio terminal device of the present invention further comprises a propagation environment estimator for detecting at least any one of a received power, and a polarization or directivity of an arrival radio wave, to notify the antenna characteristic switching section, wherein the antenna characteristic switching section performs a predetermined switching on the basis of the notification. According to this configuration, the polarization and the directivity of an antenna can be automatically switched according to the propagation environment so that the user can be served with communications without awareness and in a state with much higher sensitivity.

Also, a radio terminal device of the present invention further comprises a tilt detector for detecting the tilt angle of the radio terminal device to notify the antenna characteristic switching section, wherein the antenna characteristic switching section performs a predetermined switching on the basis of the notification. According to this configuration, the polarization and the directivity of an antenna can be automatically switched according to the slope of the radio terminal device so that the user can be served with communications without awareness and in a state with much higher sensitivity.

Meanwhile, in a radio terminal device of the present invention, the antenna characteristic switching section has a switch and a coil being connected each other in series, one end of the coil being connected to the antenna element.

Furthermore, in a radio terminal device of the present invention, the antenna characteristic switching section has a diode and a coil being connected each other in series.

According to the above configuration, the polarization and the directivity of an antenna can be switched with a simple configuration so that a small-sized radio terminal device can be produced.

Meanwhile, in a radio terminal device of the present invention, the antenna element is any one of a loop antenna, dipole antenna, and diversity antenna.

Furthermore, in a radio terminal device of the present invention, the antenna element is a dipole antenna and also an array antenna configured by two antenna elements.

According to the above configuration, a small antenna can be arranged at a case so that a small-sized radio terminal device can be produced.

According to the present invention as described above, an antenna in which the directivity thereof at the same frequency band is switched can be realized by a simple configuration. Due to this, a small-sized radio terminal device can be obtained. Meanwhile, by switching the antenna characteristic according to the usage pattern, the propagation environment or the slope of a radio terminal device, the reception characteristic suitable for each situation can be obtained.

BEST MODE FOR CARRYING OUT THE INVENTION

Embodiments of the present invention are demonstrated hereinafter with reference to the drawings.

Embodiment 1

Figure 1:
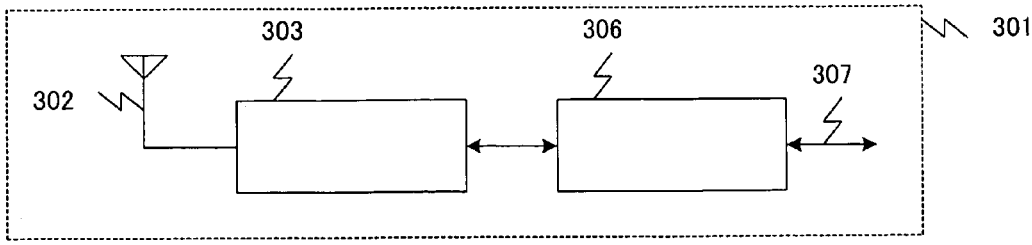
FIG. 1 is a block diagram illustrating a configuration of a radio terminal device in a first embodiment of the present invention.

FIG. 1 shows a configuration of a radio terminal device of the present embodiment.

Figure 2:
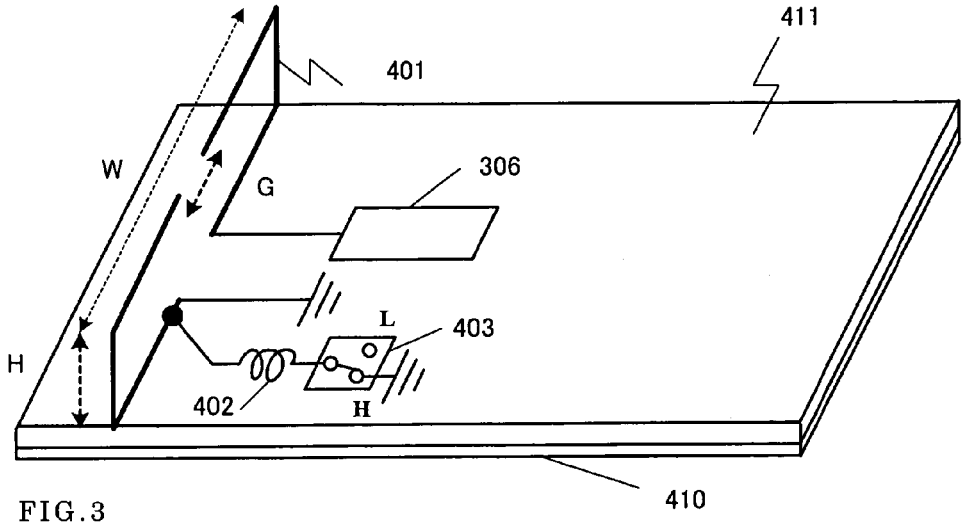
FIG. 2 is a block diagram illustrating a detailed configuration of a radio terminal device in a first embodiment of the present invention.

A radio terminal device 301 has an antenna element 302, an antenna characteristic switching section 303 and a RF circuit section 306. More specific configuration example is shown in FIG. 2.

The antenna element 302 is, for example, a turned-up dipole antenna 401 of about a half wavelength, placed on a substrate 411 in a symmetrical arrangement. The both ends of the turned-up dipole antenna 401 are brought close each other, wherein one end is connected to the RF circuit section 306 and the other end is connected to a conductive substrate 410 which is formed on all over the backside of the substrate 411 through a through-hole. In this configuration, an unbalanced feeding is performed. The conductive substrate 410 in this case corresponds to a conductive substrate.

The antenna characteristic switching section 303 has a coil 402 and a switch 403. The H terminal of the switch 403 is connected to the conductive substrate 410 through a through-hole. This switch 403 changes selectively whether to connect or disconnect to the conductive substrate 410.

When the switch 403 is connected to the L terminal side, feeding points of the turned-up dipole antenna 401 are connected to the RF circuit section 306 and the conductive substrate 410. Therefore is provided an unbalanced feeding. However, in the case of a configuration of the present embodiment as shown in FIG. 2 wherein the turned-up dipole antenna 401 is arranged symmetrically with respect to the conductive substrate 410, current distribution concentrates on and in the vicinity of the turned-up dipole antenna 401, thereby providing the same characteristic as an antenna element in a balanced feeding. Therefore, the polarized wave of the radio terminal device 301 is the one in which the component in the y-axis direction is dominant as represented by Arrow 501 in FIG. 3.

On the other hand, when the switch 403 is connected to the H terminal, current flows also onto the conductive substrate 410. This phenomenon destroys the balance of the current distribution which concentrates on and in the vicinity of the turned-up dipole antenna 401. Because of the current distribution existing not only on and in the vicinity of the turned-up dipole antenna 401 but also on the conductive substrate 410, there is shown the same characteristic as in the case of an antenna element which is provided with an unbalanced feeding. Therefore, the polarized wave of the radio terminal device 301 is the one in which the component in the z-axis direction is dominant as represented by Arrow 502 in FIG. 3. That is, by switching the switch 403, the characteristic of an antenna can be switched between a balanced feeding characteristic and an unbalanced feeding characteristic. In this manner, the direction of polarized wave can be changed.

Figure 4A:
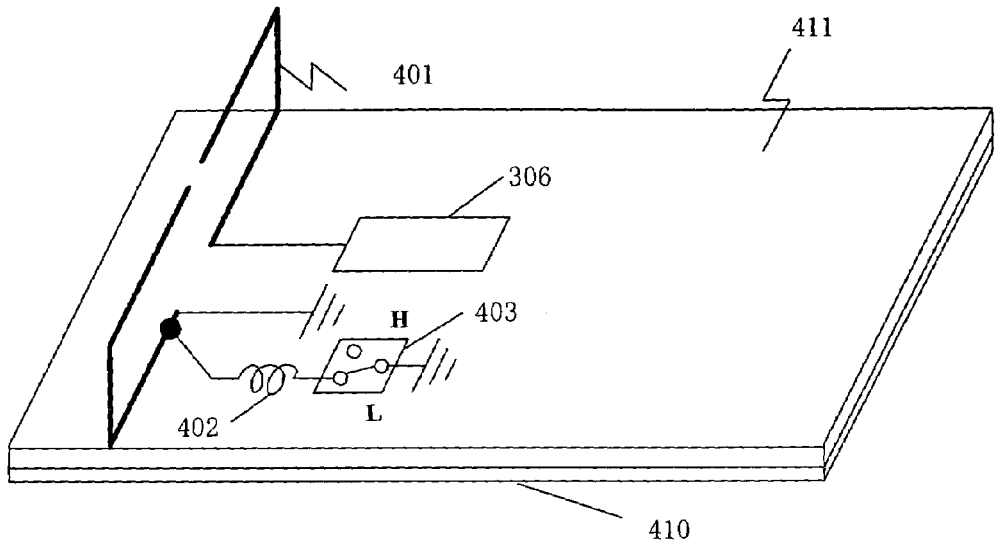
FIG. 4A is a block diagram illustrating a detailed configuration of a radio terminal device in a first embodiment of the present invention.
Figure 4B:
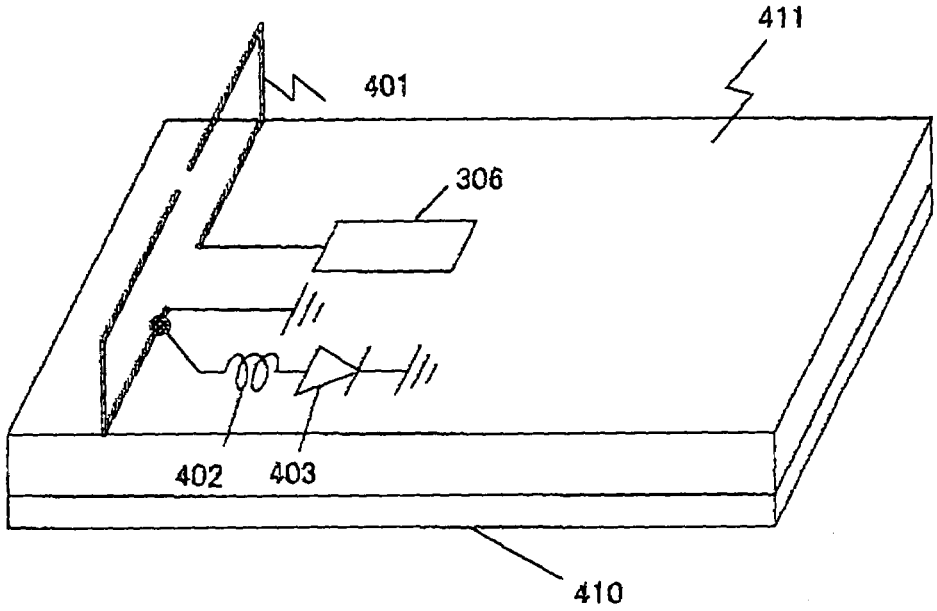
FIG. 4B is a block diagram illustrating a detailed configuration of another type of radio terminal device in the first embodiment of the present invention.

As a switch 403, for example, a SPDT (Single Pole Double Throw) switch can be used. Any other devices can be substituted if only they have two or more switching functions. Also, diodes such as a PIN diode can be substituted for the switch 403, as illustrated in FIG. 4B. Other devices than diodes can be substituted if only they have a function to switch over between connection and disconnection to the conductive substrate 410. Incidentally, grounding of the switch 403 can be provided at a common terminal side as shown in FIG. 4A or FIG. 4B.

Figure 5:
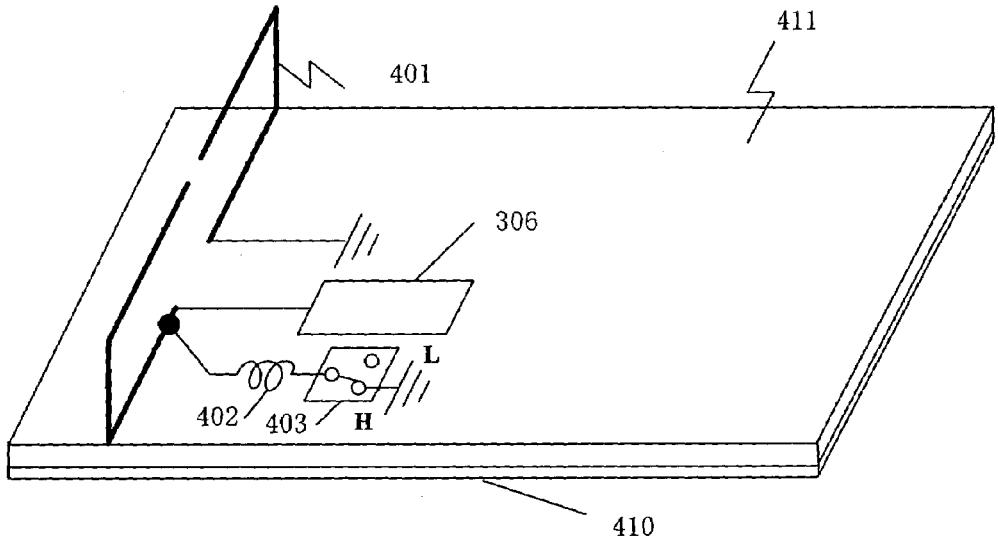
FIG. 5 is a block diagram illustrating a detailed configuration of a third type of radio terminal device in a first embodiment of the present invention.

Furthermore, as shown in FIG. 5, it is also possible to provide a switch 403 on the high frequency side where a RF circuit section 306 is arranged. Even in this configuration, the antenna characteristic can be switched between a balanced feeding characteristic and unbalanced feeding characteristic. As a result, such an effect is obtainable that the direction of a polarized wave can be selectively changed.

Figure 6:
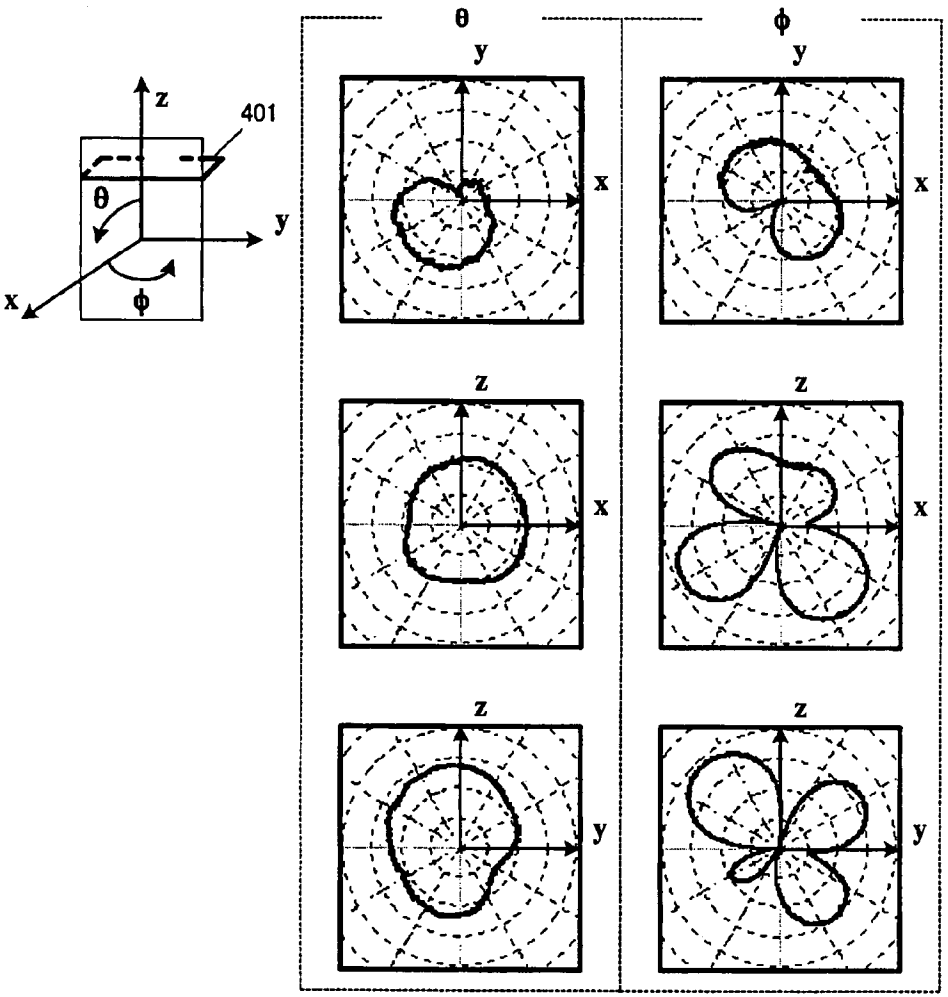
FIG. 6 is a diagram illustrating a radiation characteristic of an antenna for a radio terminal device in a first embodiment of the present invention.
Figure 7:
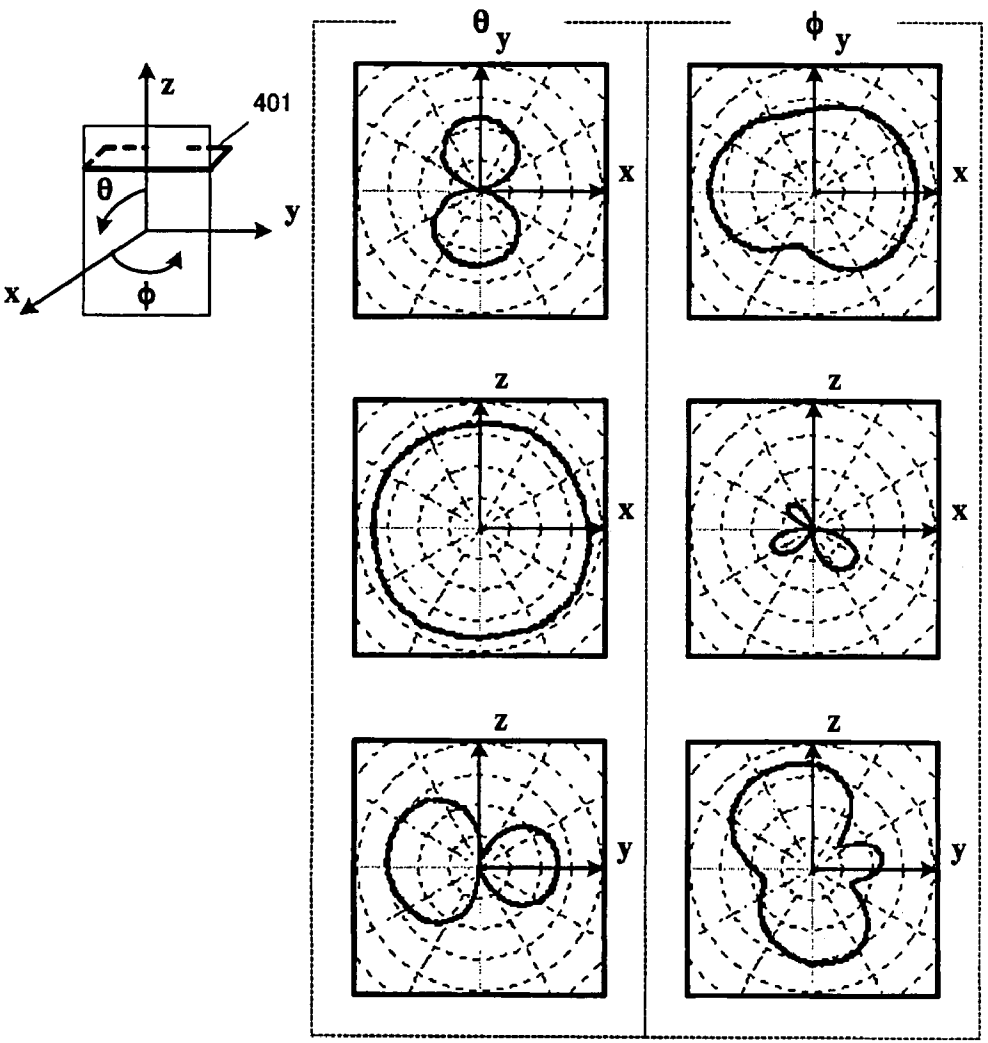
FIG. 7 is a diagram illustrating a radiation characteristic of an antenna for a radio terminal device in a first embodiment of the present invention.

FIGS. 6 and 7 show radio directivities of the radio terminal device 301 as shown in the block diagram FIG. 2, which are measured in the same frequency band under the following prerequisite: letting one wavelength=λ, the width W=0.233 λ, the height H=0.067 λ, the gap G=0.0072 λ, and the turned-up dipole antenna 401 has a full length L=2W+2H−2G=0.59 λ (namely, length of about 0.5 wavelength). FIG.6 shows a radio directivity where the switch 403 is switched over to the H terminal to provide an unbalanced feeding characteristic. FIG. 7 shows a radio directivity where the switch 403 is switched over to the L terminal to provide a balanced feeding characteristic.

Figure 8:
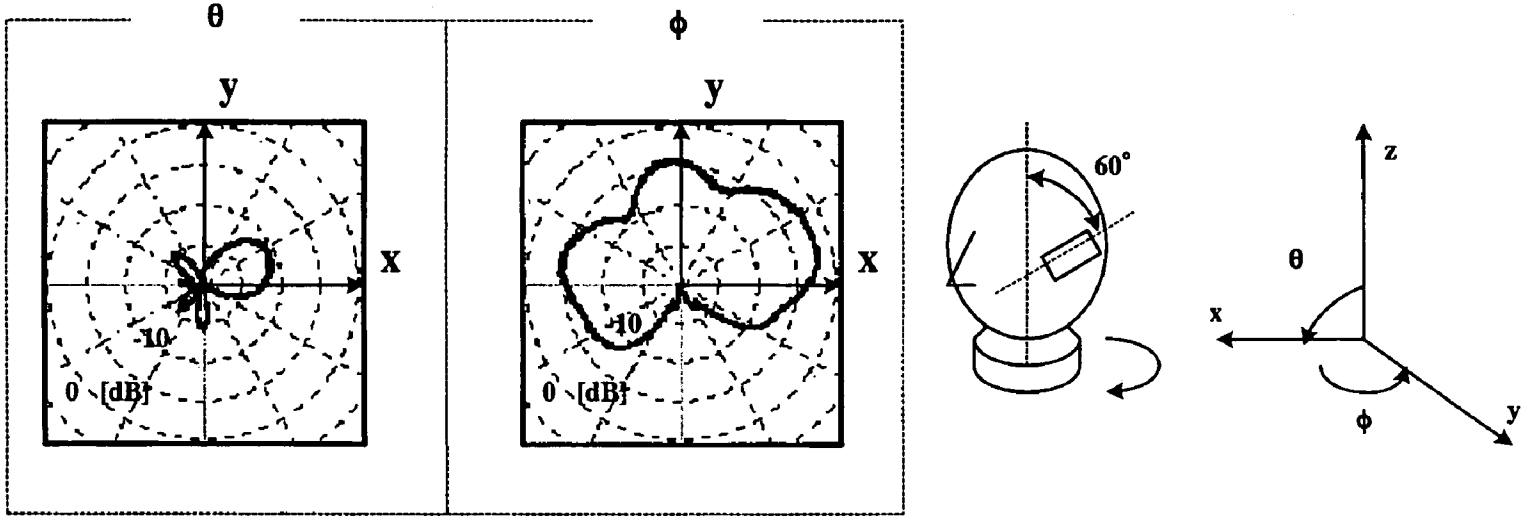
FIG. 8 is a diagram illustrating a radiation characteristic of an antenna for a radio terminal device in a first embodiment of the present invention.
Figure 9:
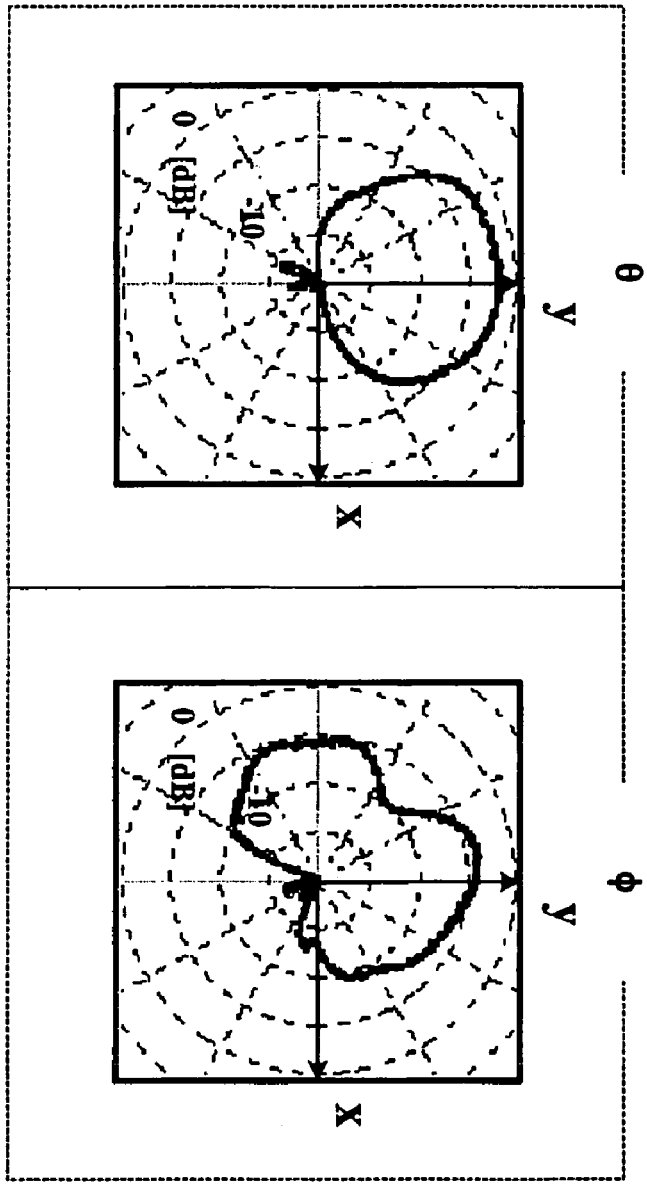
FIG. 9 is a diagram illustrating a radiation characteristic of an antenna for a radio terminal device in a first embodiment of the present invention.

Incidentally, FIGS. 8 and 9 show radio directivities of the radio terminal device 301 in the use state of a telephone call mode in which a user holds the radio terminal device 301 in the left hand. FIG. 8 shows a radio directivity where the switch 403 is switched to the H terminal to provide an unbalanced feeding characteristic. FIG. 9 shows a radio directivity where the switch 403 is switched to the L terminal to provide a balanced feeding characteristic.

However, a resonance frequency of the turned-up dipole antenna 401 is changed in response to the position of a contact point between the coil 402 and the turned-up dipole antenna 401 and the value of the coil 402. Therefore it is also possible to adjust the resonance frequency not only by the length of antenna elements but also by the contact point and the value of the coil.

As described above, in the case that the radio terminal device 301 configured in the present embodiment is held in the left hand of a user in a telephone call state, the polarization directivity thereof is like the followings: when the switch 403 is switched to the H terminal side, the horizontal composition is dominant as shown in FIG. 8; and when the switch 403 is switched to the L terminal side, the vertical composition is dominant as shown in FIG. 9.

Figure 3:
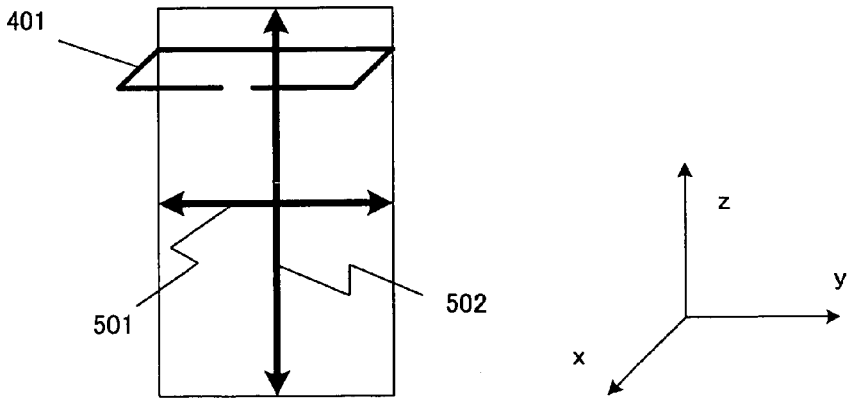
FIG. 3 is a diagram illustrating a polarization characteristic of a radio terminal device in a first embodiment of the present invention.
Figure 21:
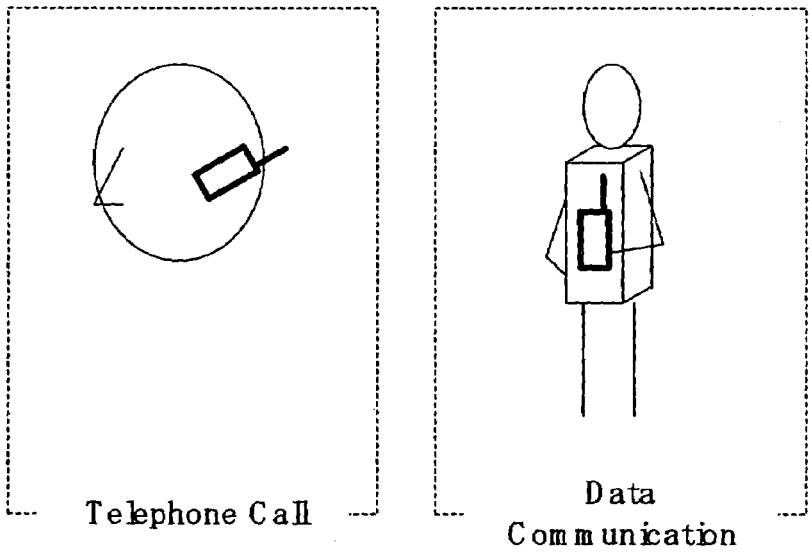
FIG.21 PRIOR ART
FIG. 21 is a diagram illustrating an example of usage patterns of a radio terminal device.
Figure 22:
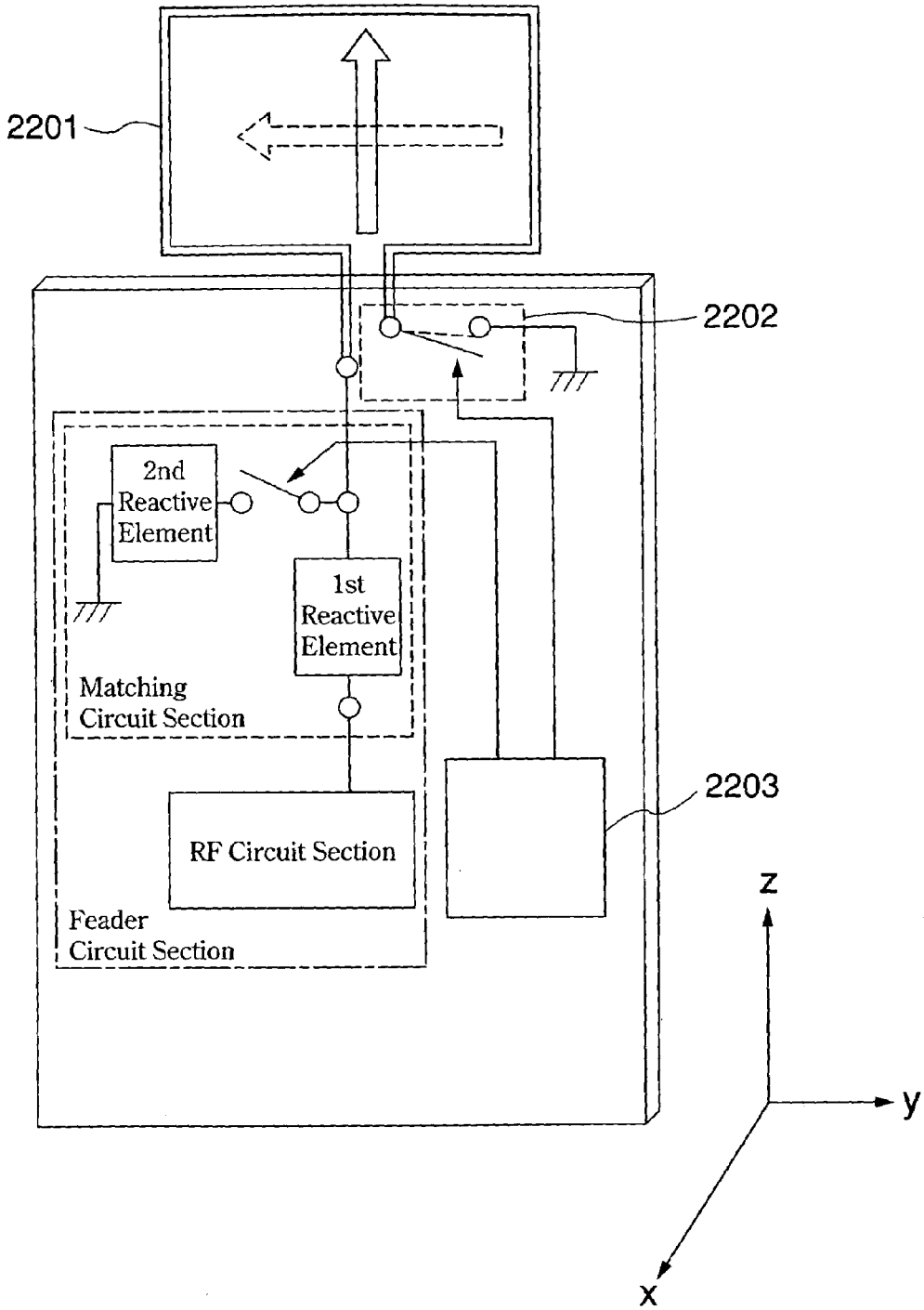
FIG.22 PRIOR ART
FIG. 22 is a block diagram illustrating a configuration of a conventional radio terminal device.
Figure 23:
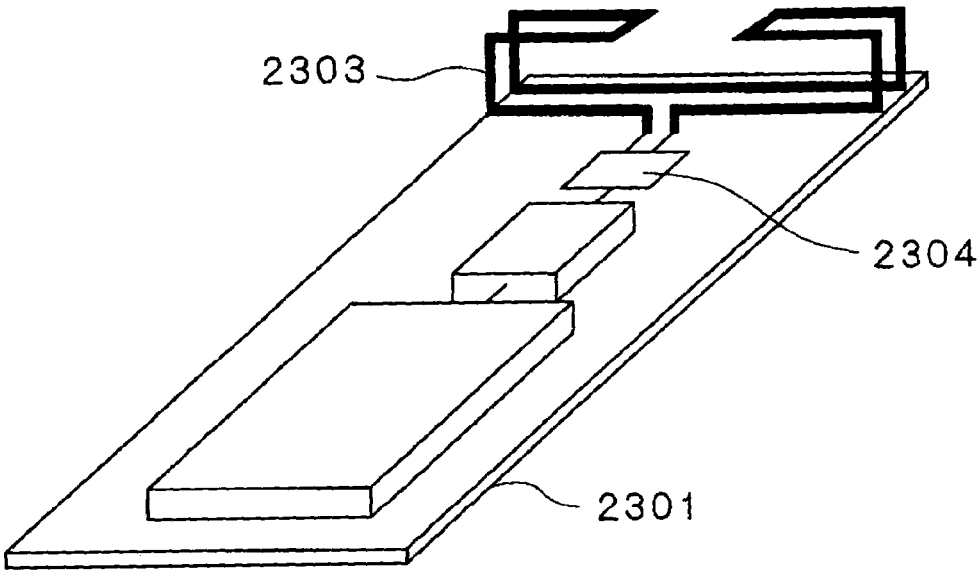
FIG.23 PRIOR ART
FIG. 23 is a block diagram illustrating a configuration of a conventional radio terminal device.
Figure 24B:
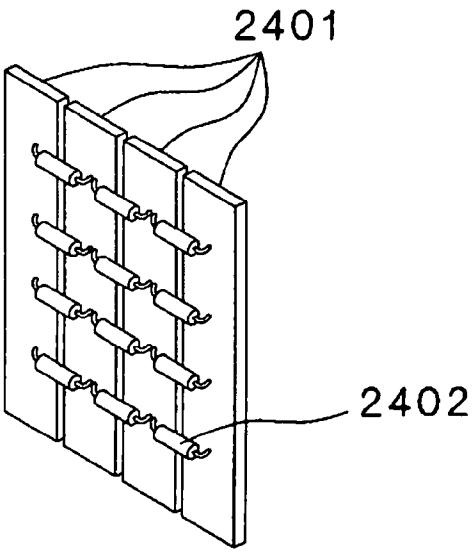
FIG.24B PRIOR ART
FIGS. 24A and 24B are diagrams illustrating a configuration of a current distribution control section of a conventional radio terminal device.
Figure 24A:
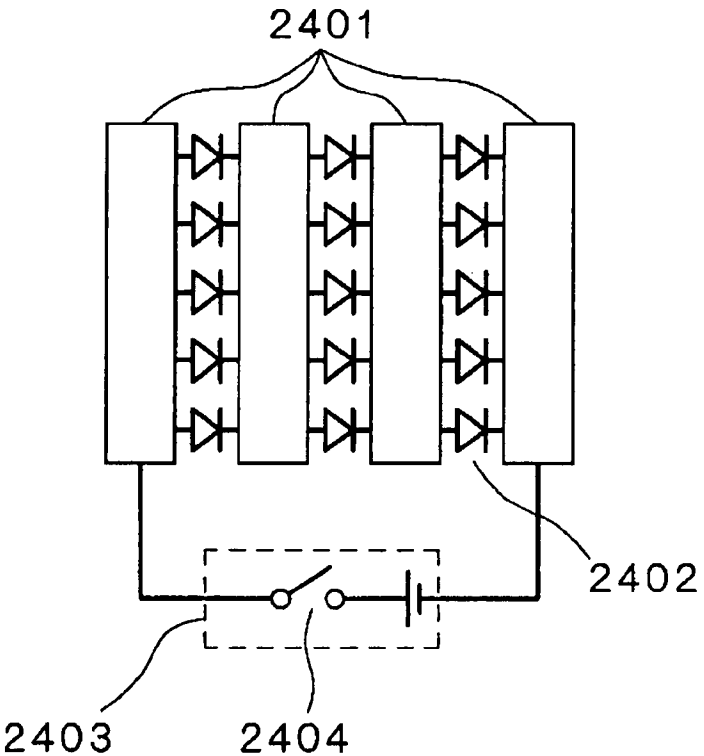
FIG.24A PRIOR ART

Herein, in a radio communication system in which transmission/reception to/from the base station is performed with vertical polarization, polarization loss of the radio terminal device 301 caused is decreased when, in a telephone call mode as shown in FIG. 21 for example, the polarization shows such a characteristic where a component in the y-axis direction is dominant as represented by Arrow 501 in FIG. 3 because of less mismatching in polarization. Meanwhile, in a data communication mode as shown in FIG. 21, the polarization loss is decreased when the polarization shows such a characteristic where a component in the z-axis direction is dominant as represented by Arrow 502 in FIG. 3.

Consequently, when the switch 403 in FIG. 2 is switched to the L terminal side, the characteristic in-a telephone call mode is good. And when, the switch 403 is switched to the H terminal side, the characteristic in a data communication mode is good.

As described above, according to the present embodiment, directivities of antenna can be changed in the same frequency band by switching between concentrating the current distribution on and in the vicinity of the antenna element and expanding the current distribution not only on and in the vicinity of the antenna element but also onto the conductive substrate with the use of the switch 403. In doing so, it is possible to enhance the received power characteristic of the radio terminal device 301, in each usage pattern of a telephone call mode and a data communication mode.

Figure 10:
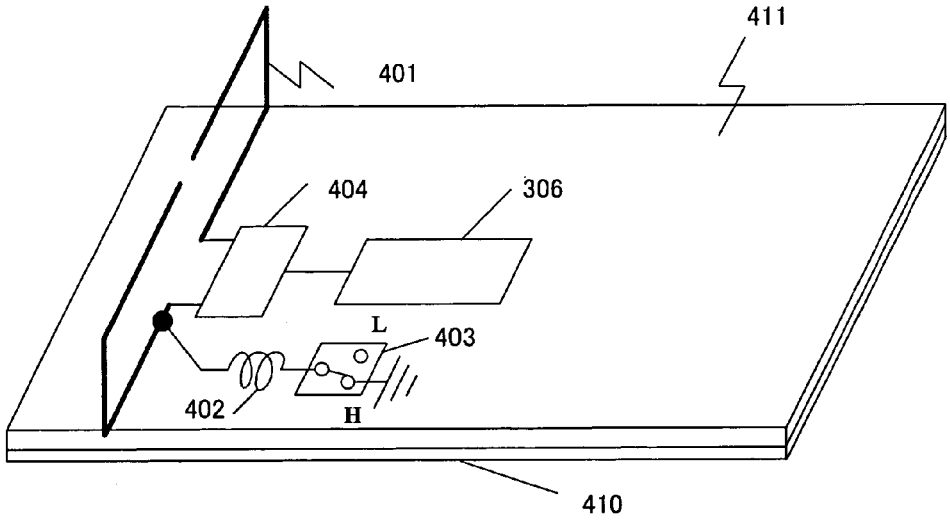
FIG. 10 is a block diagram illustrating a detailed configuration of a radio terminal device in a first embodiment of the present invention.

Incidentally, the antenna element 302 is not limited to a turned-up dipole antenna. A folded loop antenna and so forth may be substituted. Also, the same effect is obtainable in a configuration in which an antenna is provided with a balanced feeding through a balanced/unbalanced converter 404 as shown in FIG. 10.

Embodiment 2

Figure 17:
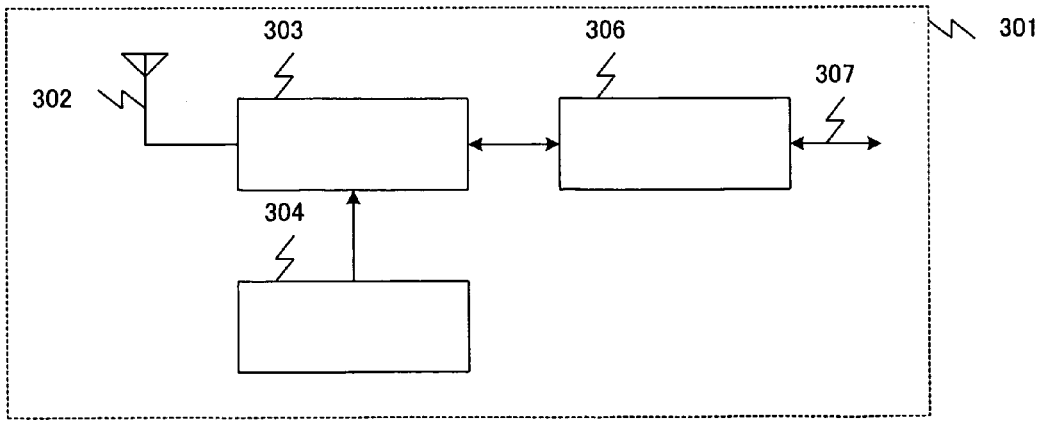
FIG. 17 is a block diagram illustrating a configuration of a radio terminal device in a second embodiment of the present invention.

FIG. 17 shows a configuration of the radio terminal device of the present embodiment. This embodiment has a configuration where an operating pattern estimator 304 is further added to the radio terminal device of Embodiment 1. Any other configuration thereof is the same with Embodiment 1.

This operating pattern estimator 304, in accordance with the usage pattern of the radio terminal device, is to determine the characteristic of the antenna element 302 suitable for the usage pattern thereof, outputting signals to an antenna characteristic switching section 303 for switching the antenna characteristic.

For example, the operating pattern estimator 304 estimates whether the usage pattern of the radio terminal device is a telephone call mode or data communication mode. This usage pattern estimation is available before communication starts by, for example, detecting whether or not it's a data communication mode (packet communication mode), whether or not there is a voice input/output through the microphone/speaker, or by detecting the pre-added signals for discriminating communication modes. The operating pattern estimator 304 issues instructions on the basis of these detection results so that the switch 403 can be switched to the L terminal side in a telephone call mode, and to the H terminal side in a data communication mode.

As described above, according to the present embodiment, polarization to be used in communication can be automatically changed over in accordance with its usage pattern. This can reduce the polarization loss in communication while users are not aware of it. As a result, communication with higher sensitivity can be realized.

Embodiment 3

Figure 11:
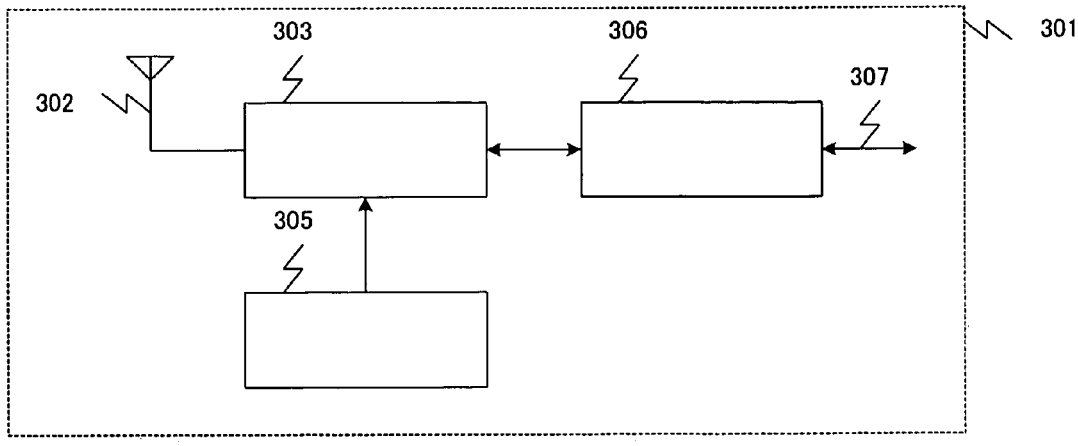
FIG. 11 is a block diagram illustrating a configuration of a radio terminal device in a third embodiment of the present invention.

FIG. 11 shows a configuration of the radio terminal device of the present embodiment. This embodiment is different from Embodiment 2 in that a propagation environment estimator 305 is substituted for the operating pattern estimator 304.

This propagation environment estimator 305, in accordance with the propagation environment, is to determine the characteristic of the antenna element 302 suitable for the propagation environment, thus outputting a signal to an antenna characteristic switching section 303 for switching the antenna characteristic.

For example, the propagation environment estimator 305 monitors received power, polarization or direction of arrival radio waves and so on.

Figure 12A:
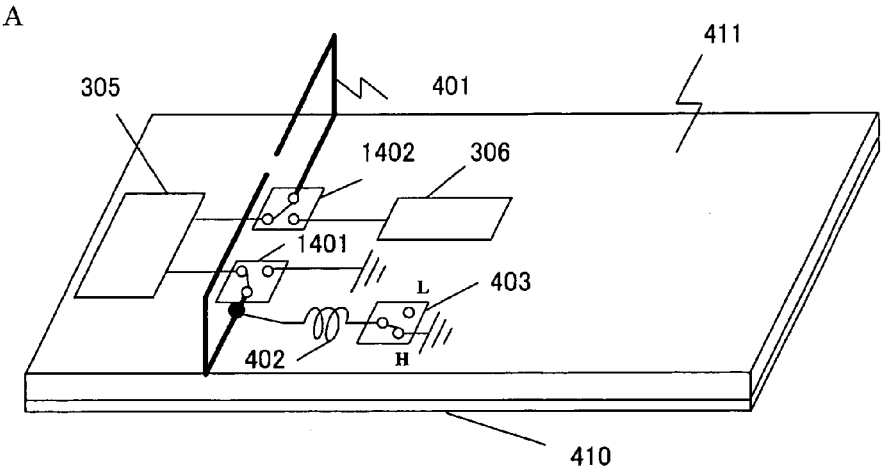
FIGS. 12A to 12C are block diagrams illustrating a detailed configuration of a radio terminal device in a third embodiment of the present invention.
Figure 12B:
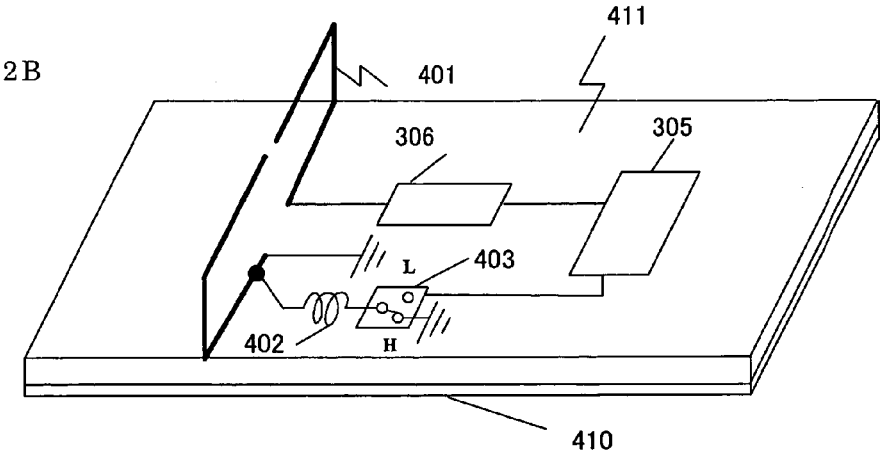
Figure 12C:
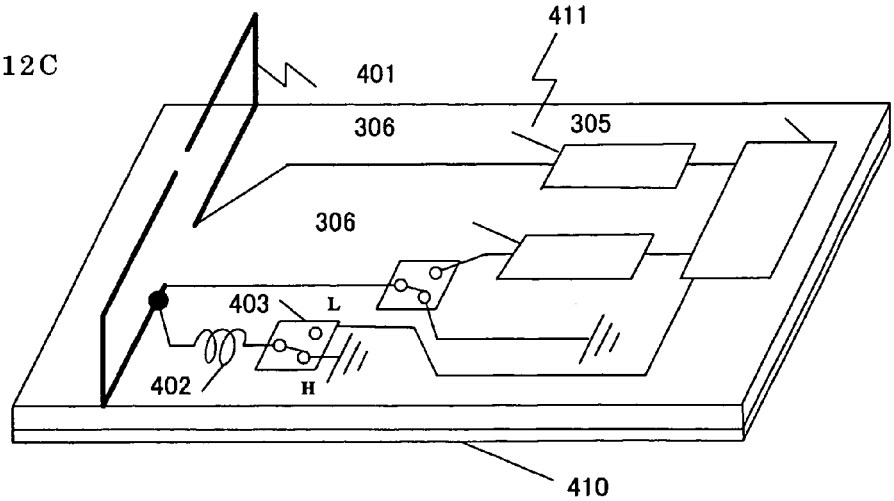

FIGS. 12A to 12C show configurations where the direction of an arrival radio wave is monitored. An antenna element 401 can be connected to the propagation environment estimator 305 through switches 1401 and 1402. Because the antenna element 401 can also be recognized as an array antenna configured by two antenna elements, the propagation environment estimator 305 can estimate the direction of arrival radio waves that are transmitted from the base station by further including detection of the phase difference between the two antenna elements or amplitudes. As a result, it is possible to give instructions for changing the switch 403 to the characteristic suitable for its arrival direction.

Incidentally, ability for estimating arrival direction is not limited to this configuration: similar function is available also in a configuration where the propagation environment estimator 305 includes an array antenna.

Meanwhile, in FIG. 12B, the propagation environment estimator 305 is connected to a RF circuit section 306 to estimate the arrival direction on the basis of the output results obtained by this RF circuit section 306. In FIG. 12C, there are provided two RF circuits 306 and estimation for the arrival direction is made on the basis of the output results respectively obtained by these two RF circuit sections 306.

Figure 13:
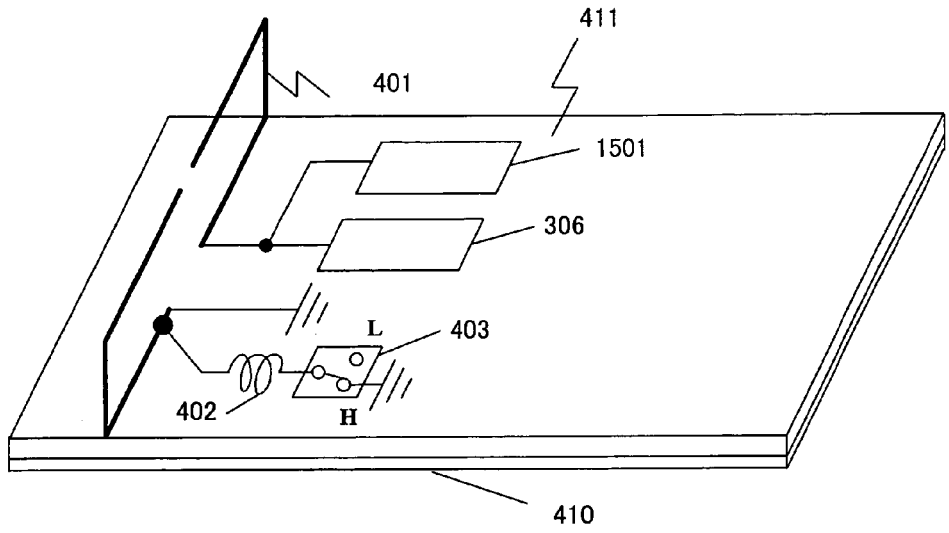
FIG. 13 is a block diagram illustrating a detailed configuration of a radio terminal device in a third embodiment of the present invention.

Next, FIG. 13 shows a configuration to monitor received power. In FIG. 13, a received power determination section 1501, which corresponds to the propagation environment estimator, is to detect received power, issuing instructions for changing a switch 403 to the terminal side with higher received power. Meanwhile, the received power determination section 1501 can be placed anywhere as far as it can monitor received power. For example, it can be included in a RF circuit section 306; alternatively, it can be configured to monitor the output from the RF circuit section 306.

Figure 14:
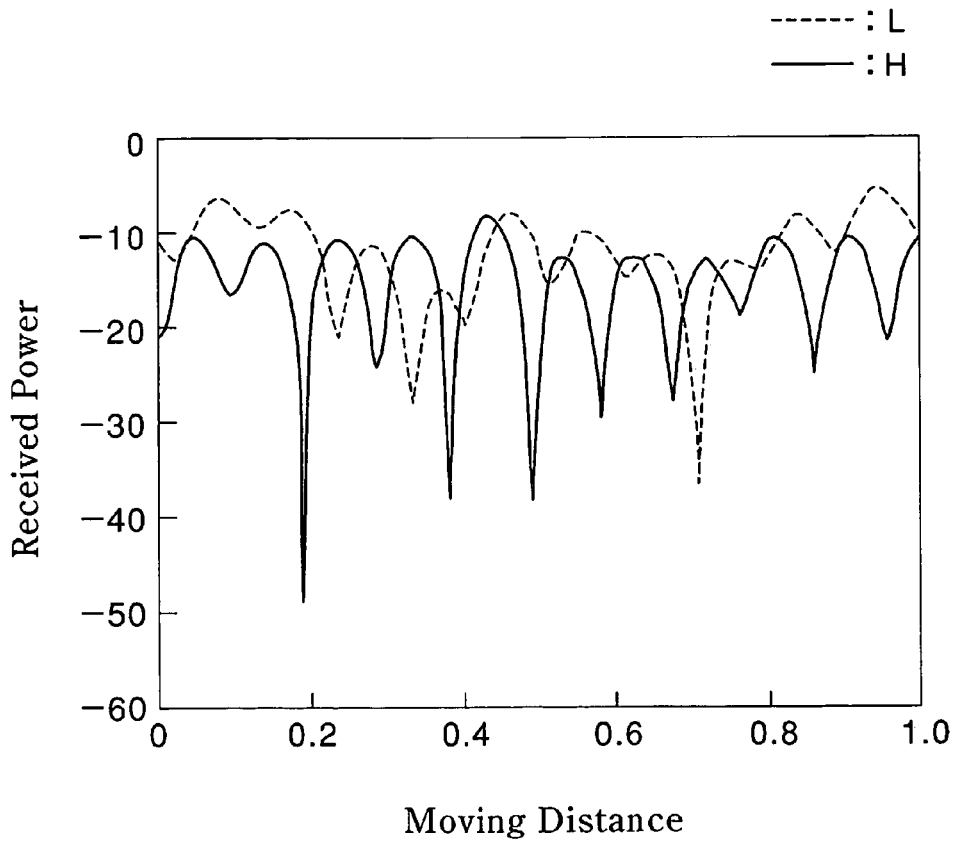
FIG. 14 is a graph illustrating a receiving power characteristic of an antenna for a radio terminal device in a third embodiment of the present invention.

FIG. 14 shows the characteristics of received power in the cases where the switch 403 is connected to the H terminal side and to the L terminal side, assuming that the radio terminal device 301 is held in the left hand in a telephone call mode while moving. As shown in FIG. 14, even in the telephone-call usage only, there is a difference not only in the value but also in the dropping timing of received power between the cases of the H terminal side and the L terminal side, which can be switched over by the switch 403. That is to say, there is very low correlation provided. Therefore, the present invention is good for configuration of a diversity antenna with low correlation. As described above, according to the present embodiment, communication with higher sensitivity is available by changing over the polarization to be used for communication in accordance with the propagation environment.

Embodiment 4

Figure 15:
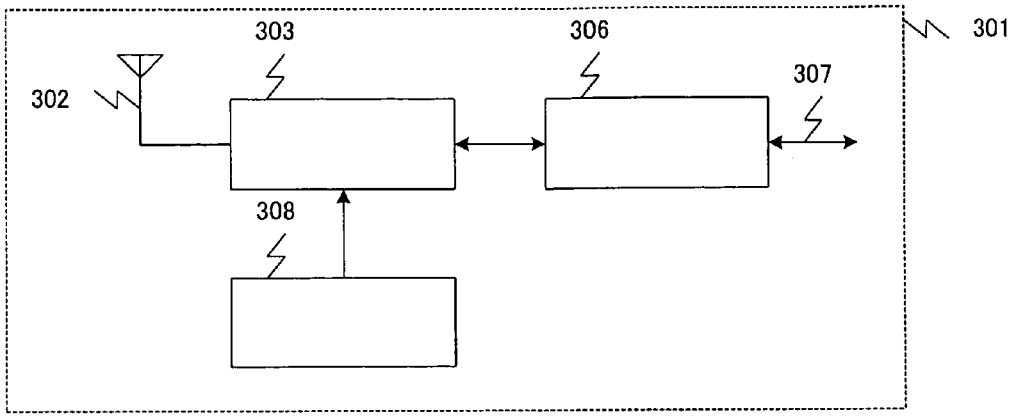
FIG. 15 is a block diagram illustrating a configuration of a radio terminal device in a fourth embodiment of the present invention.

FIG. 15 shows a configuration of the radio terminal device of the present embodiment. This embodiment is different from Embodiment 2 in that a tilt detector 308 is substituted for the operating pattern estimator 304 of Embodiment 2.

This tilt detector 308 is to detect the tilt angle of the radio terminal device 301, determine the characteristic of an antenna element 302 suitable for the tilt angle, then outputting signals to an antenna characteristic switching section 303 in order to change over the connection.

As a tilt detector 308, for example, a tilting switch can be used. What is representative as a tilting switch is a well-closed container including balls and bars inside. When the container tilts by itself, balls and bars inside also tilt together to make electrical contacts ON/OFF.

By using this, polarization can be changed over as follows: when the radio terminal device, turning around the x-axis in FIG. 3, tilts by 45 degrees or more, polarization is to be switched to the direction of Arrow 501; when the radio terminal device tilts by less than 45 degrees, polarization is to be switched to the direction of Arrow 502. As a result of that, in a radio communication system in which radio waves are transmitted and received with a fixed polarization from the base station, it allows the radio terminal device to reduce the polarization loss caused by the polarization mismatch, thus upgrading the reception characteristic.

Furthermore, in a usage pattern where telephone call mode and data communication mode are operated simultaneously like a case of videophone or a telephone call while operating a packet communication in parallel, it allows the radio terminal device to improve its communication sensitivity by switching the polarization to be used for communication in response to the tilt angle of the radio communication terminal.

Embodiment 5

Figure 16:
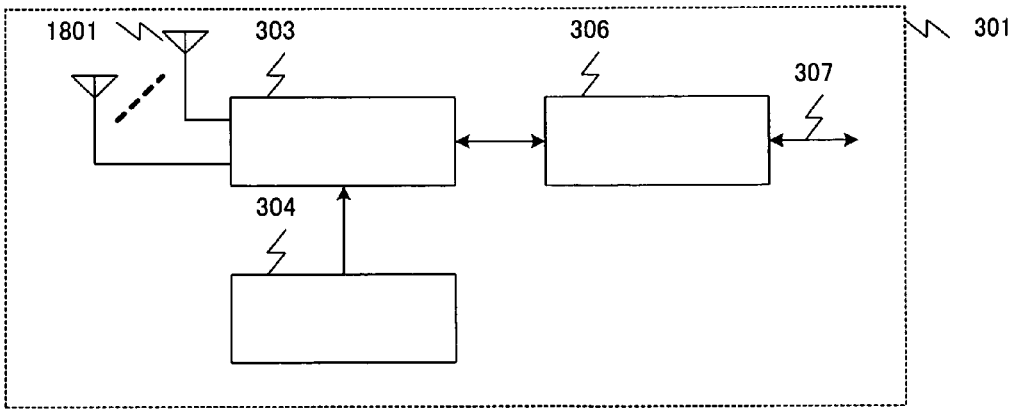
FIG. 16 is a block diagram illustrating a configuration of a radio terminal device in a fifth embodiment of the present invention.

FIG. 16 shows a configuration of the radio terminal device of the present embodiment. This embodiment is different from Embodiment 1 in that the radio terminal device has plural antennas. Specific configuration thereof is shown in FIG. 18.

Figure 18:
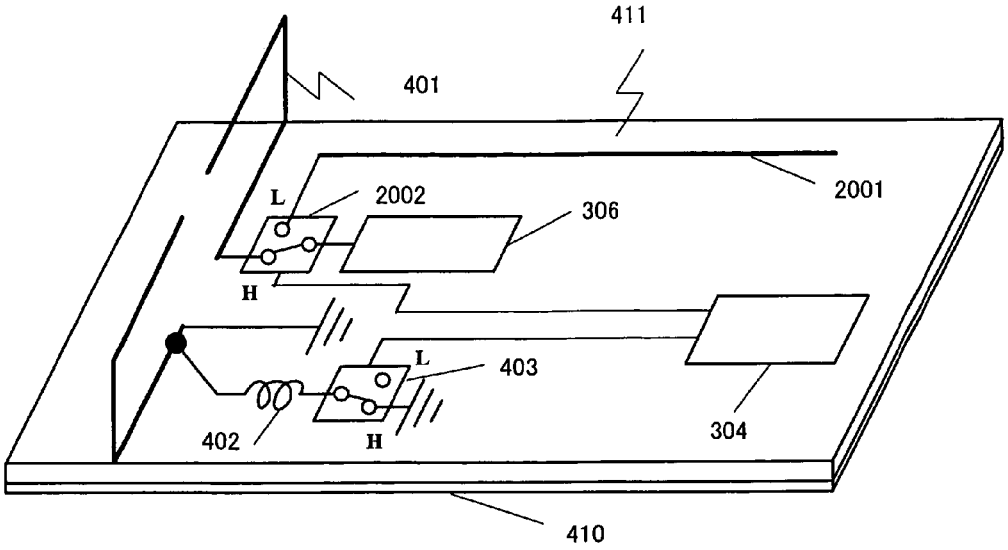
FIG. 18 is a block diagram illustrating a detailed configuration of a radio terminal device in a fifth embodiment of the present invention.

In FIG. 18, an antenna element 2001 and a switch 2002 is added to the original configuration of Embodiment 1. An operating pattern estimator 304 is connected to switches 403 and 2002, controlling each of them in response to the operating pattern.

For example, in a stand-by mode, the antenna element 2001 with a nearly-nondirectional characteristic is to be used because it is better for the efficiency of transmission/reception to use a nondirectional antenna when the disposition state of the radio communication terminal is not known. In this case, in a telephone call mode, the switch 403 is to be set to the L terminal side and the switch 2002 is to be set to the H terminal side. In a data communication mode, the switch 403 is to be set to the H terminal side and the switch 2002 is to be set to the H terminal side. On the other hand, in a stand-by mode, the switch 403 can be set to either H/L terminal, and the switch 2002 is to be set to the L terminal side in order to change over to the antenna element 2001. In this manner, it is possible to switch antennas in accordance with the three situations.

As described above, configuration with plural antenna elements will make it possible to control the antenna characteristic to be more adaptive to the operating pattern.

Incidentally, it is also possible to use the propagation environment estimator of Embodiment 3 or the tilt detector of Embodiment 4 instead of the operating pattern estimator 304 so that the antenna with the most adaptive reception characteristic can be selected among plural antennas.

Embodiment 6

Figure 19:
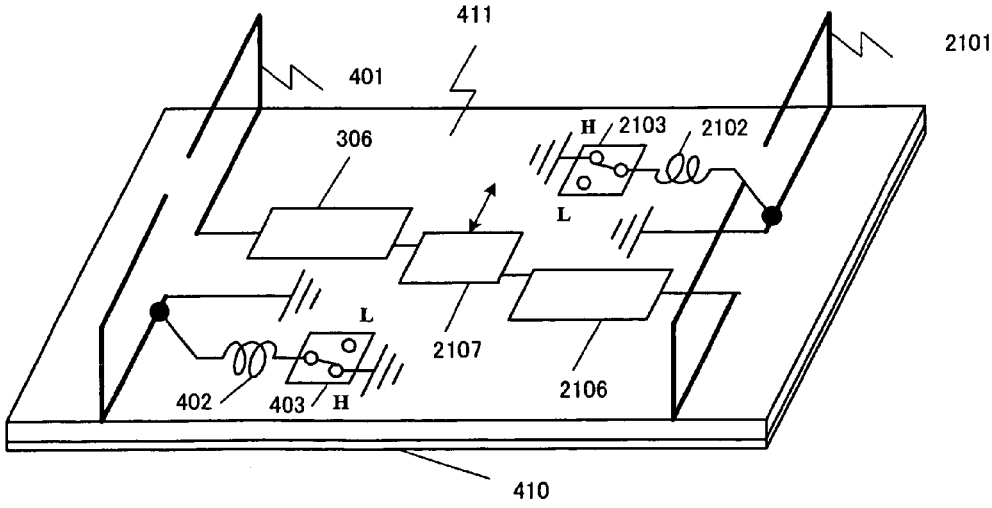
FIG. 19 is a block diagram illustrating a detailed configuration of a radio terminal device in a sixth embodiment of the present invention.
Figure 20:
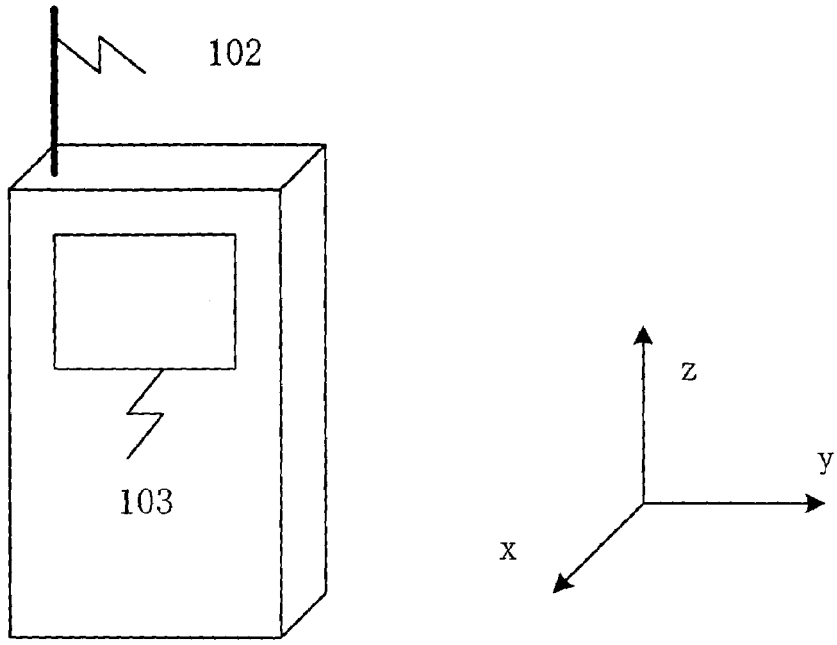
FIG.20 PRIOR ART
FIG. 20 is a diagram illustrating a conventional antenna.

FIG. 19 shows a configuration of the radio terminal device of the present embodiment. In this embodiment, the radio terminal device has a configuration comprising plural antennas and plural RF circuit sections.

In FIG. 19, the radio terminal device further includes an antenna element 2101, coil 2102, switch 2103, RF circuit section 2106, and a splitter 2107 in addition to the original configuration of Embodiment 1. Herein, the splitter 2107 has a function to separate input signals into the RF circuit sections 306 and 2106 and combine input signals inputted from the RF circuit sections 306 and 2106.

An antenna configured by the antenna element 401, coil 402, switch 403 and the RF circuit section 306, and an antenna configured by the antenna element 2101, coil 2102, switch 2103 and the RF circuit section 2106 are respectively changed between an unbalanced feeding characteristic and a balanced feeding characteristic by respectively switching the switch 403 and switch 2103. Therefore each antenna can have a different characteristic from the other. In this manner, like the case as shown in FIG. 14 of Embodiment 3, it is possible to configure a radio terminal device having two antennas, the received power characteristics thereof having very low correlation.

The above configuration can also be applied to antennas for MIMO (Multi Input Multi Output) system by setting the switch 403 to the L terminal side so that the antenna element 401 may be provided with the balanced feeding characteristic and by setting the switch 2103 to the H terminal side so that the antenna element 2101 may be provided with the unbalanced feeding characteristic. Meanwhile, MIMO is exemplified by BLAST (Bell Labs Layered Space-Time).

Also, the present invention can be applied to a multiple polarization system because it can transmit and receive two kinds of polarized waves as shown in FIG. 3 by switching-over the switches.

Furthermore, this invention can realize transmission diversity and can also be applied to antennas for receiving or transmitting space and time codes, adaptive array antennas having two antenna elements and so forth.

Further, in a case of using the radio terminal device held in one hand, influence of the hand will be reduced by providing the antenna element closer to the hand with unbalanced feeding characteristic.

Meanwhile, such a configuration is also possible wherein the characteristic of one or both of the antennas are fixed without using switches.

INDUSTRIAL APPLICABILITY

An antenna for a radio terminal device and a radio terminal device according to the present invention are useful in the radio terminal device necessary for switching the antenna characteristic and suitable for reduction in the size.

The invention claimed is:

1. An antenna for a radio terminal device comprising:
(a) an antenna element;
(b) and an antenna characteristic switching section for switching the antenna characteristic between a balanced feeding characteristics and an unbalanced feeding characteristics by switching between states in which a current distribution exists only on and in a vicinity of the antenna element and in which the current distribution exists not only on and in the vicinity of the antenna element but also on other portions.

2. An antenna for a radio terminal device according to claim 1, wherein the antenna element is connected with a conductive substrate arranged close in parallel to a long side of the antenna element with a sufficiently small spacing as compared with a wavelength in a twisted position relationship, and
the antenna characteristic switching section is connected to one end of the antenna element in a vicinity of the conductive substrate, for changing a state of continuity with the conductive substrate.

3. An antenna for a radio terminal device according to claim 1, wherein any one of a loop antenna, a dipole antenna, and a diversity antenna is used as the antenna element.

4. An antenna for a radio terminal device comprising:
(a) an antenna element; and
(b) an antenna characteristic switching section for switching between states in which a current distribution exists only on and in a vicinity of the antenna element and in which the current distribution exists not only on and in the vicinity of the antenna element but also on other portions,
wherein the antenna characteristic switching section has either of a switch and a diode, and a coil connected to each other in series.

5. An antenna for a radio terminal device according to claim 4, wherein the antenna element is a dipole antenna and also an array antenna configured by two antenna elements.

6. A radio terminal device comprising:
(a) an antenna for a radio terminal device, said antenna including:
(1) an antenna element, and
(2) an antenna characteristic switching section for switching the antenna characteristic between a balanced feeding characteristics and an unbalanced feeding characteristics by switching between states in which a current distribution exists only on and in a vicinity of the antenna element and in which the current distribution exists not only on and in the vicinity of the antenna element but also on other portions; and
(b) a RF circuit section connected to one end of the antenna element.

7. A radio terminal device according to claim 6, wherein the antenna element is any one of a loop antenna, a dipole antenna, and a diversity antenna.

8. A radio terminal device comprising;
(a) an antenna for a radio terminal device, said antenna including:
(1) an antenna element, and
(2) an antenna characteristic switching section for switching between states in which a current distribution exists only on and in a vicinity of the antenna element and in which the current distribution exists not only on and in the vicinity of the antenna element but also on other portions; and
(b) a RF circuit section connected to one end of the antenna element,
wherein the antenna element is connected with a conductive substrate arranged close in parallel to a long side of the antenna element with a sufficiently small spacing as compared with a wavelength in a twisted position relationship, and
the antenna characteristic switching section is connected to an other end of the antenna element in a vicinity of the conductive substrate, for changing a state of continuity with the conductive substrate.

9. A radio terminal device according to claim 8, further comprising:
an operating pattern estimator for discriminating whether a present communication media is a telephone call or a data communication, to notify the antenna characteristic switching section,
wherein the antenna characteristic switching section performs a predetermined switching on the basis of the notification.

10. A radio terminal device according to claim 8, further comprising:
a propagation environment estimator for detecting a received power, a polarization of an arrival radio wave or a direction of an arrival radio wave, to notify the antenna characteristic switching section,
wherein the antenna characteristic switching section performs a predetermined switching on the basis of the notification.

11. A radio terminal device according to claim 8, further comprising:
a tilt detector for detecting a tilt angle of the radio terminal device to notify the antenna characteristic switching section,
wherein the antenna characteristic switching section performs a predetermined switching on the basis of the notification.

12. A radio terminal device according to claim 8, wherein the antenna characteristic switching section has either of a switch and a diode, and a coil being connected to each other in series, one end of the coil being connected to said antenna element.

13. A radio terminal device according to claim 8, wherein the antenna element is a dipole antenna and also an array antenna configured by two antenna elements.

14. A radio terminal device according to claim 8, further comprising:

a further antenna element that is used in a stand-by mode.

15. A radio terminal device according to claim 8, wherein the antenna includes one or more sets of antennas paired with a respective two or more RF circuit sections, the radio terminal device further comprising:

a splitter which combines signals from said two or more RE circuit sections, or divides a signal into the respective RF circuit sections, wherein the splitter connects with the respective RF circuit sections.

16. A radio terminal device comprising:

(a) an antenna element;

(b) a conductive substrate arranged close in parallel to a long side of the antenna element with a sufficiently small spacing as compared with a wavelength in a twisted position relationship;

(c) a balanced/unbalanced converter connected to both ends of the antenna element;

(d) a RF circuit section connected to said antenna element through said balanced/unbalanced converter; and (e) an antenna characteristic switching section connected to the antenna element in a vicinity of the conductive substrate, for changing a state of continuity with the conductive substrate.

17. A radio terminal device according to claim 16, further comprising:

an operating pattern estimator for discriminating whether a present communication media is a telephone call or a data communication, to notify the antenna characteristic switching section, wherein the antenna characteristic switching section performs a predetermined switching on the basis of the notification.

18. A radio terminal device according to claim 16, further comprising:

a propagation environment estimator for detecting a received power or a polarization and direction of an arrival radio wave, to notify the antenna characteristic switching section, wherein the antenna characteristic switching section performs a predetermined switching on the basis of the notification.

19. A radio terminal device according to claim 16, further comprising:

a tilt detector for detecting a tilt angle of the radio terminal device to notify the antenna characteristic switching section, wherein the antenna characteristic switching section performs a predetermined switching on the basis of the notification.

20. A radio terminal device according to claim 16, wherein the antenna characteristic switching section has either of a switch and a diode, and a coil being connected to each other in series, one end of the coil being connected to said antenna element.

21. A radio terminal device according to claim 16, wherein the antenna element is a dipole antenna and also an array antenna configured by two antenna elements.

22. A radio terminal device according to claim 16, wherein the antenna element is connected with the conductive substrates, and the antenna characteristic switching section is connected to one end of the antenna element in the vicinity of the conductive substrate.

* * * * *

UNITED STATES PATENT AND TRADEMARK OFFICE

CERTIFICATE OF CORRECTION

PATENT NO. : 7,212,164 B2
APPLICATION NO. : 10/505372
DATED : May 1, 2007
INVENTOR(S) : Kentaro Miyano et al.

It is certified that error appears in the above-identified patent and that said Letters Patent is hereby corrected as shown below:

Title Page, Item (56) References Cited, FOREIGN PATENT DOCUMENTS
Delete duplicate "EP 120600 A2 5/2002"

Column 12
Line 19, change ";" to -- : --

Column 13
Line 15, change "RE" to -- RF --

Column 14
Line 31, change "substrates" to -- substrate --

Signed and Sealed this

Seventh Day of August, 2007

JON W. DUDAS
*Director of the United States Patent and Trademark Office*